US006011205A

United States Patent [19]

Tucker et al.

[11] Patent Number: 6,011,205

[45] Date of Patent: Jan. 4, 2000

[54] MATERIAL AND METHOD FOR CONSTRUCTION OF SOLID BODY STRINGED INSTRUMENTS

[76] Inventors: John Nichols Tucker, P.O. Box 801; John Stanley Morrall, P.O. Box 751, both of Hanalei, Hi. 96714

[21] Appl. No.: 09/053,910

[22] Filed: Apr. 1, 1998

[51] Int. Cl.[7] ..... G10D 3/00

[52] U.S. Cl. ..... 84/291; 84/290

[58] Field of Search ..... 84/275, 290, 291

[56] References Cited

U.S. PATENT DOCUMENTS

| | | | |
|---|---|---|---|
| 4,103,583 | 8/1978 | Takabayashi . | |
| 4,126,073 | 11/1978 | Takabayashi . | |
| 4,185,534 | 1/1980 | Cove . | |
| 4,290,336 | 9/1981 | Peavey . | |
| 4,334,452 | 6/1982 | Morrison, III et al. . | |
| 5,125,311 | 6/1992 | Boulanger et al. | 84/291 |
| 5,235,891 | 8/1993 | Klein . | |
| 5,616,873 | 4/1997 | Fishman et al. | 84/293 |

OTHER PUBLICATIONS

James A. Duke, Handbook of Energy Crops, available at www.hort.purdue.edu/newcrop 1983.

"IDRC: Library: Documents: Wood Utilization", 1997.

*Primary Examiner*—Robert E. Nappi

*Assistant Examiner*—Marlon Fletcher

*Attorney, Agent, or Firm*—Seth M. Reiss

[57] ABSTRACT

A stringed instrument having a solid body constructed of albizzia wood that is lightweight, durable, offers an aesthetically pleasing appearance and is capable of demonstrating good tonal quality over a broad range of pitches played acoustically or amplified. The body of said instrument is formed from a single piece of albizzia or from a plurality of pieces, arranged longitudinally, and joined using splines in conjunction with adhesive or by other known methods. Albizzia, having a high tensile strength and low specific gravity, allows for the production of light weight solid body instruments without the cost, complexity and degradation of sound quality of solid body instruments having composite body construction. A thin veneer can be added to cover the solid albizzia body for added strength and aesthetic variation. Also described is a method for selecting and preparing the albizzia wood and alternative constructions wherein the instrument neck traverses a portion, or forms the central section, of the solid body.

19 Claims, 6 Drawing Sheets

MATERIAL AND METHOD FOR CONSTRUCTION OF SOLID BODY STRINGED INSTRUMENTS

BACKGROUND

1. Field of Invention

This invention relates to stringed musical instruments and, more particularly, to a material and method for constructing amplified solid body stringed musical instruments such as electric guitars.

2. Description of the Prior Art

Electronic amplification of musical instruments has lead to the emergence and current importance of solid body stringed instruments. Most notable among solid body stringed instruments are electric guitars. Solid body electronic guitars are now well known and understood and can be found fabricated from a variety of material using a variety of construction techniques.

Having a history that is short relative to their acoustic cousins, efforts to discover improved materials and methods for construction of amplified solid body stringed instruments are ongoing. Not surprisingly, therefore, electric guitars have been the subject of a number of recent improvements and patents covering the same.

Ideally, materials employed in the construction of solid body stringed instruments should have characteristics for strength, tonal quality, dependability and aesthetic appearance. Strength is necessary to enable the instrument body to counterbalance forces resulting from highly tensioned strings. The material must also be suitable for anchoring screws which secure the tensioned components to the instrument body. Tonal quality is an obvious goal of all musical instruments, and aesthetic appearance holds importance to the instruments owner as well as to the image that is projected whenever the instrument is demonstrated or performed.

Solid body instruments fabricated from certain woods have been found to produce better quality sounds over a wider range of tones than instruments fabricated from other woods and from synthetic materials. Certain hardwoods like ash, although strong and aesthetically pleasing in a finished state, lack tonal quality and produce a dull sound when used in solid guitar bodies. Recognized preferred woods, sometimes referred to in the industry as tone woods, include Honduras mahogany, alder, basswood, korina and swamp ash. These woods produce better quality sounds which are distinctive and vary in quality over the range of pitches. Solid body guitars fabricated from alder, for example, produce a brighter sound as compared with solid body guitars fabricated from mahogany.

It has also been noted that solid body stringed instruments capable of producing a pleasing tonal quality when played acoustically, as do tone woods, generally also produce attractive sounds when amplified. Solid bodies made of woods which produce poor quality sound unamplified generally also lack tonal quality when the sound is electrified.

One recognized drawback of solid body stringed instruments is their weight. While hardwoods exhibit the requisite tensile strength and, some, pleasing tonal qualities, the completed instrument is significantly heavier than its hollow body counterpart causing the musician discomfort and early fatigue during practice sessions, recitals and performances.

Prior art patents attempting to address the weight problem teach solid body guitars having composite construction that include, for example, a softwood such as balsa or a synthetic such as foam. While offering a light weight alternative, use of the composites body construction can compromise sound quality as sound waves degrade and lose coincidence as they traverse materials having different density. Composite construction also increases the complexity, and consequent cost, of the finished product.

OBJECTS AND SUMMARY OF THE INVENTION

An objective of the present invention is to provide a material for the construction of solid body stringed instruments which is light in weight relative to the woods traditionally employed in electric guitars, sufficiently strong to withstand the forces of highly tensioned strings and suitable for anchoring components thereto.

It is a further object of the present invention to provide a solid body stringed instrument which maximizes string vibrations.

It is a further object of the present invention to provide a solid body stringed instrument which is durable, dependable and has a long usable life expectancy.

It is a further object of the present invention to provide a solid body stringed instrument capable of producing a high quality sound over a broad range of frequencies when played acoustically and when amplified by electronic or other means.

It is a further object of this invention to provide a solid body stringed instrument which is light weight and durable, exhibits pleasing tonal quality, and which is simple and inexpensive to manufacture relative to other solid body stringed instruments.

It is yet another object of the present invention to provide a solid body stringed instrument that is aesthetically pleasing when finished without sacrificing performance, durability or tonal quality.

These and other objects are achieved according to the present invention, a solid body stringed instrument having a body comprised of albizzia wood. Albizzia is a light weight wood having high tensile strength found growing predominantly in warm climates. Albizzia wood demonstrates the necessary strength to withstand forces produced by tensioned guitar strings and is suitable for anchoring components subject to significant pressure through the use of screws, bolts and adhesives. It can thus be used to comprise the body of solid body stringed instruments without being combined with high strength, high density, materials. Albizzia wood, having a lower specific gravity and being less dense than the hardwoods presently employed in solid body electric guitars, produces a solid body instrument that is more than one third lighter than the solid body hardwood instruments currently available.

Albizzia wood employed in solid body stringed instruments produces high quality sounds over a wide range of musical pitches, played acoustically as well as amplified. In a finished state, albizzia wood projects an appearance no less aesthetically pleasing than the hardwoods presently used in solid body electric guitars.

In the method of construction of the instant invention, albizzia wood is selected, harvested, cut into planks and air cured under controlled conditions. Once cured, the wood is cut to form the instrument body. Solid instrument bodies may be of one piece construction or may be composed of two or more longitudinally arranged sections of albizzia and joined by splines or other means. The instrument neck may attach at one end of the solid body or may traverse the body as further described below.

Further objects and advantages of this invention will become apparent from consideration of the drawings and ensuing description.

BRIEF DESCRIPTION OF THE DRAWINGS

The details of typical, but not limiting, embodiments of the present invention will be described in connection with the accompanying drawings.

DETAILED DESCRIPTION OF THE PREFERRED EMBODIMENTS

Figure 1:
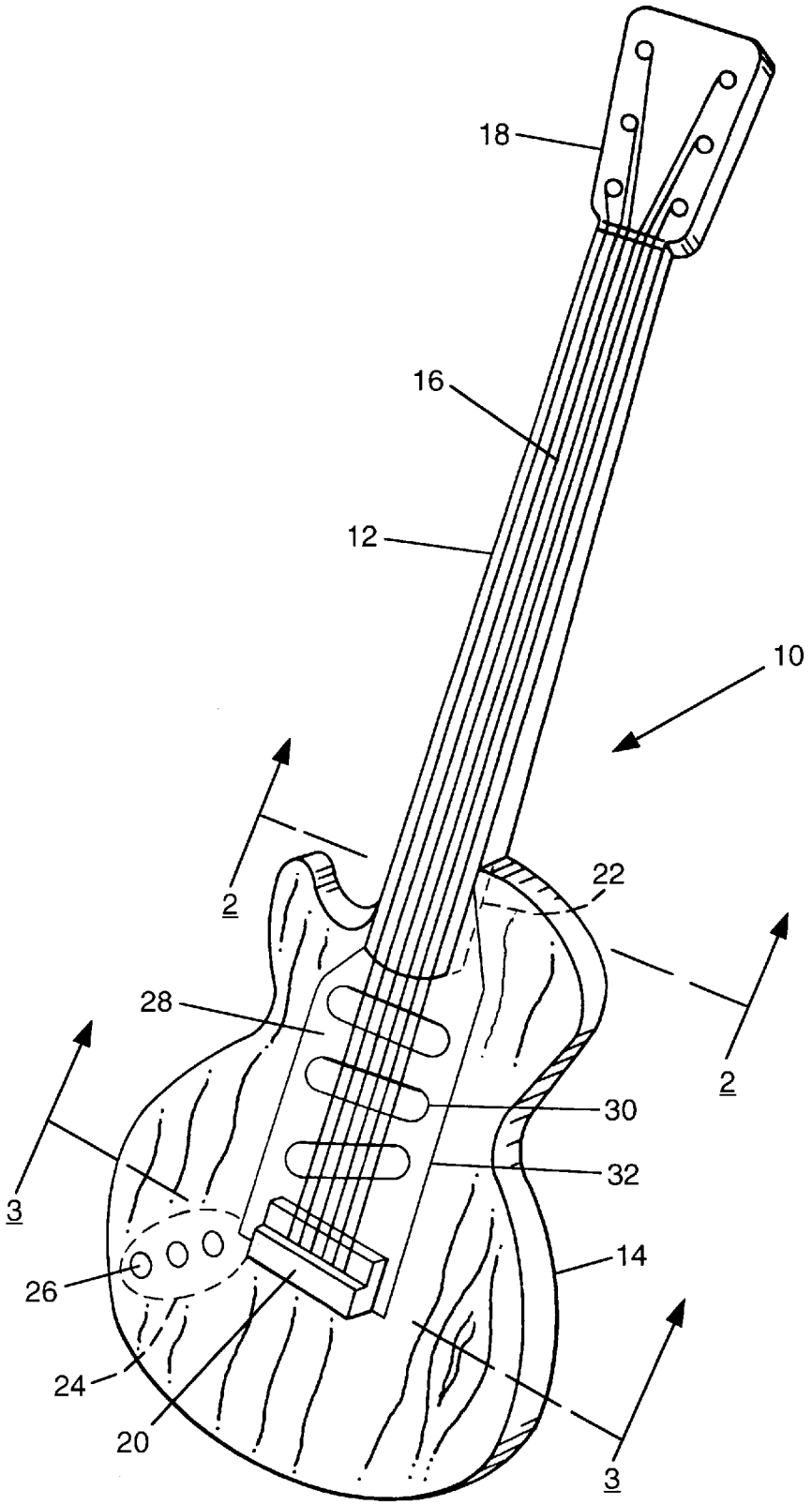
FIG. 1 is a perspective view of the solid body stringed instrument of the present invention, embodied as an electric guitar having a single piece albizzia wood body.

A preferred embodiment of the solid body stringed instrument of the subject invention, in the form of an electric guitar 10, is illustrated in FIG. 1. Guitar 10 is comprised of a neck 12, usually formed of hardwood, the base of which is attached to a solid body 14 comprised of albizzia. A plurality of strings 16 are stretched from a neck head 18 located at the proximal end of neck 12 to a bridge stop 20 located at an intermediate point on body 14. Bridge stop 20, depicted in FIG. 1, functions as a combination bridge and tail piece.

According to this embodiment, solid body 14 is cut from a single piece of albizzia wood with the wood grain running longitudinally from the top of body 14 where it attaches the base of neck 12 to the bottom of body 14. Albizzia wood comes from the albizzia tree, scientifically known as Albizia falcataria or Albizia falcata of the family Leguminosae. Native to Southeast Asia, it can also be found in South Asia, Africa and the Americas. It is highly regarded as a shade tree, has been utilized to shade agricultural crops and suggested as a material for making crates and paper. Albizzia is relatively fast growing, hearty and easily cultivated.

Carved within solid body 14 is a neck cavity 22 and accessory cavity 24, Neck cavity 22 receives the base of neck 12, while accessory cavity 24 accommodates an electronic control means 26. Lying on top of the base of neck 12 and body 14, and below strings 16, is electronic pickup assembly 28.

Pickup assembly 28 can take a variety of forms. As depicted in FIG. 1, assembly 28 comprises three electronic pickups 30 situated within a pickup housing 32 usually formed of plastic. Wire elements, not shown, connect pickups 28 to control means 26 and to a plug jack, also not shown, made accessible from without guitar body 14.

Figure 2:
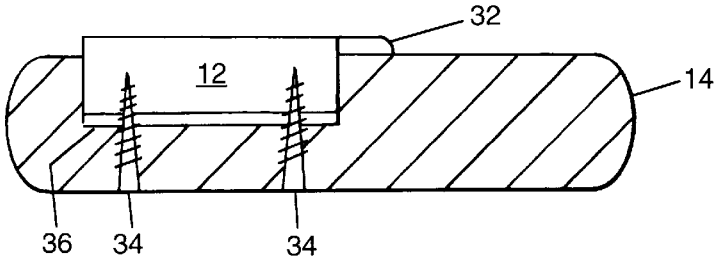
FIG. 2 is a section view through guitar body and neck base as taken through section 2—2 of FIG. 1.
Figure 3:
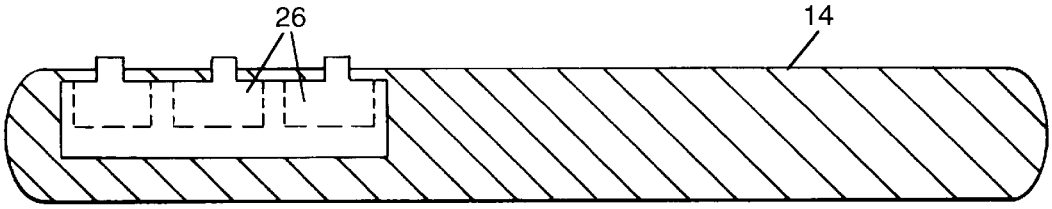
FIG. 3 is a section view through guitar body and accessory cavity as taken thorough section 3—3 of FIG. 1.
Figure 14:
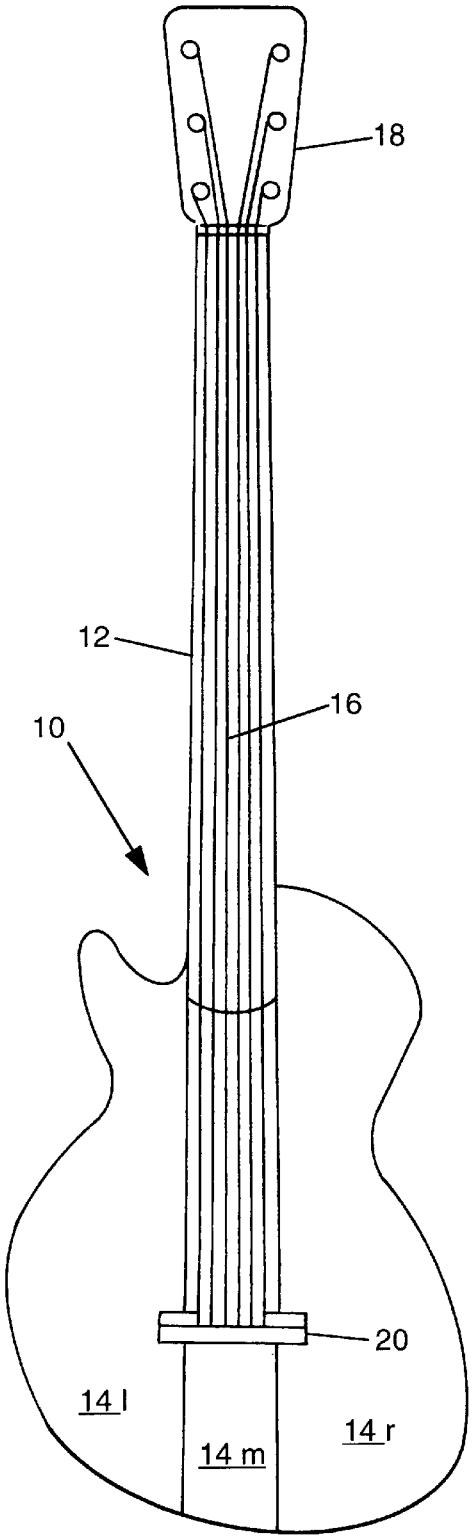
FIG. 14 is a top view of a further alternate embodiment of a solid body guitar with neck base forming the central section of a multi-piece solid body.

FIGS. 2 and 3 illustrate different aspects of the solid body of the guitar of FIG. 14. Referring first to FIG. 2, a sectional view taken along section 2—2 of FIG. 1, the hardwood base of neck 12 is embedded snugly inside neck cavity 22 and securely anchored to albizzia body 14 with a plurality of screws 34, two of which are depicted in FIG. 2. An adhesive, preferably epoxy, is applied between screws 34, body 14 and neck 12 to provide a very strong permanent bond. FIG. 2 also shows the upper portion of pickup housing 32 lying adjacent to one side of neck 12.

According to the embodiment depicted in FIG. 2, a sustain interface 36 is placed between neck 12 and body 14 prior to joining these components. Sustain platform 36, which is optional, can serve to stegnthen the combination neck 12 and body 14 while promoting the transmission of musical vibrations. Platform 36 may be formed of the hardwood used in neck 12 or other compatible material depending upon the results to be obtained.

Referring next to FIG. 3, a sectional view taken along section 3—3 of FIG. 1, albizzia body 14 demonstrates accessory cavity 24 into which electronic control means 26 is embedded. As depicted, a layer of albizzia covers the body of control means 26 leaving only the knobs of means 26 exposed.

Albizzia wood projects an attractive appearance when finished. When used by itself in the construction of body 14, the instruments main resonating components, to wit neck 12 and stop 20, are anchored to and communicate directly with body 14's core albizzia material or, in the case of the embodiment depicted in FIG. 2, through sustain interface 36. This direct communication enhances the tonal and resonating qualities of the guitar 10.

Figure 4:
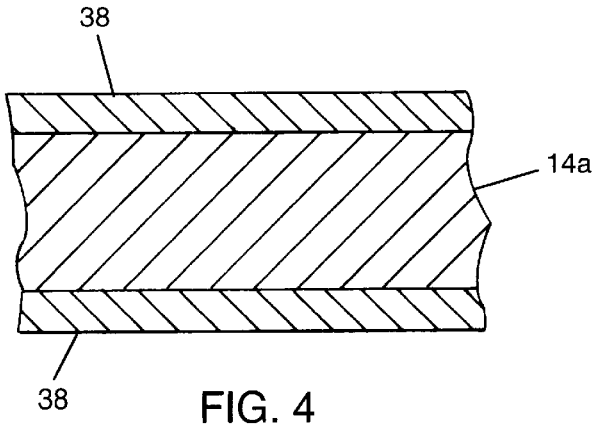
FIG. 4 is an alternate section view showing the solid body with veneer cover.

In an alternative embodiment, a thin veneer may be applied to the outside surface of a solid body constructed of albizzia without sacrificing the lightweight and tonal characteristics attributable to the albizzia. FIG. 4 illustrates such an embodiment, with solid body 14*a* composed of albizzia wood and covered with a thin veneer 38. Veneer 38 can be comprised of a finished hardwood as, for example, mahogany, maple or koa, or a highly figured albizzia veneer 38 may be layered on top of solid albizzia body 14*a*. Alternatively, veneer 38 can be fabricated of synthetic material, as for example resin. Artistic renderings may be applied within a synthetic veneer. Veneer 38 is employed for aesthetic reasons, to enhance the instrument's strength and durability, or both.

Figure 5:
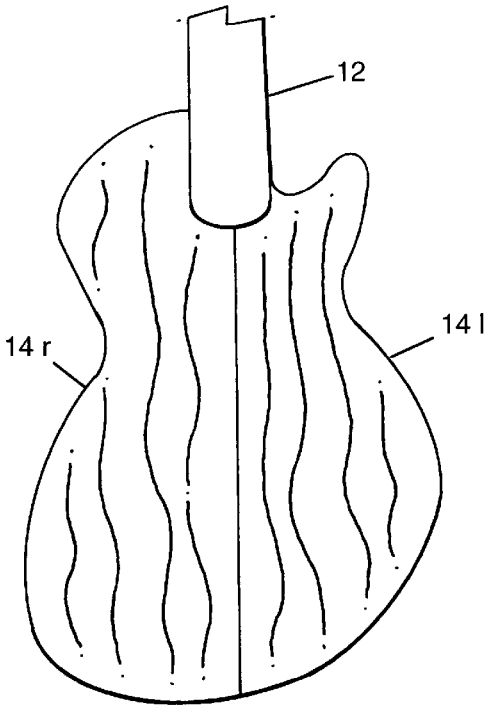
FIG. 5 is a partial bottom view showing the solid body guitar with two-piece body.
Figure 6:
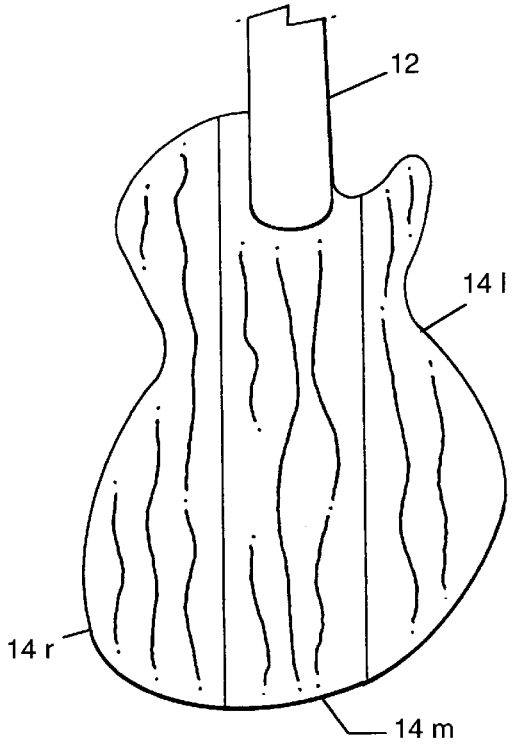
FIG. 6 is a partial bottom view showing the solid body guitar with three-piece body.
Figure 7:
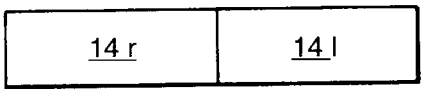
FIG. 7 is an end view of the two-piece body of the solid body guitar of FIG. 5.
Figure 8:
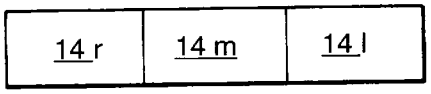
FIG. 8 is an end view of the three-piece body of the solid body guitar of FIG. 6.

FIGS. 5 through 8 illustrate alternative embodiments of guitar 10 wherein solid body 14 is comprised of a plurality of longitudinally arranged sections each fabricated from albizzia wood. FIGS. 5 and 7 are partial bottom and end views, respectively, of guitar 10 having a two-piece body 14 comprised of a left body section 14*l* and a right body section 14*r*, longitudinally arranged. FIGS. 6 and 8 are partial bottom and end views, respectively, of guitar 10 having a three-piece body 14 comprised of a left section 14*l*, a middle section 14*m* and a right section 14*r*, all longitudinally arranged. Body sections 14*r*, 14*l* and 14*m* are made from albizzia wood with grain running longitudinally, top to bottom.

Figure 9:
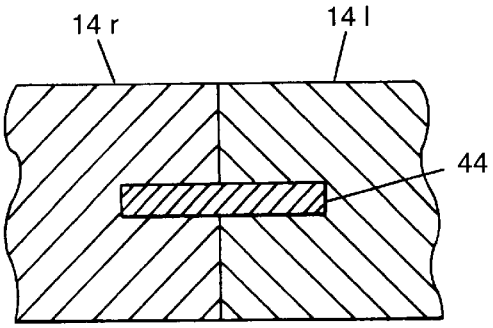
FIG. 9 is a partial section showing the joining of sections of a multi-piece solid body using a rectangular spline.
Figure 10:
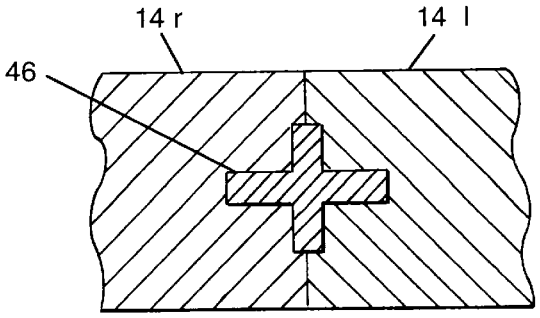
FIG. 10 is a partial section showing the joining of sections of a multi-piece solid body using an X-shaped spline.

Sections of multi-piece solid body instruments of the present invention may be joined and permanently attached, one to the other, using a variety of conventional methods. FIG. 9 is a partial section showing body sections 14*l* and 14*r* of multi-piece body 14 joined using a rectangular spline 44. FIG. 10 is a partial section showing sections 14*l* and 14*r* of multi-piece body 14 joined using an X-shaped spline 46. According to the embodiments depicted in FIGS. 9 and 10, grooves are cut along the inside edge of sections 14*l* and 14*r* to correspond to the shape of splines 44 and 46 and receive the splines. An adhesive, for example epoxy, is used to bind sections 14*l* and 14*r* to each other and to splines 44 and 46.

Figure 11:
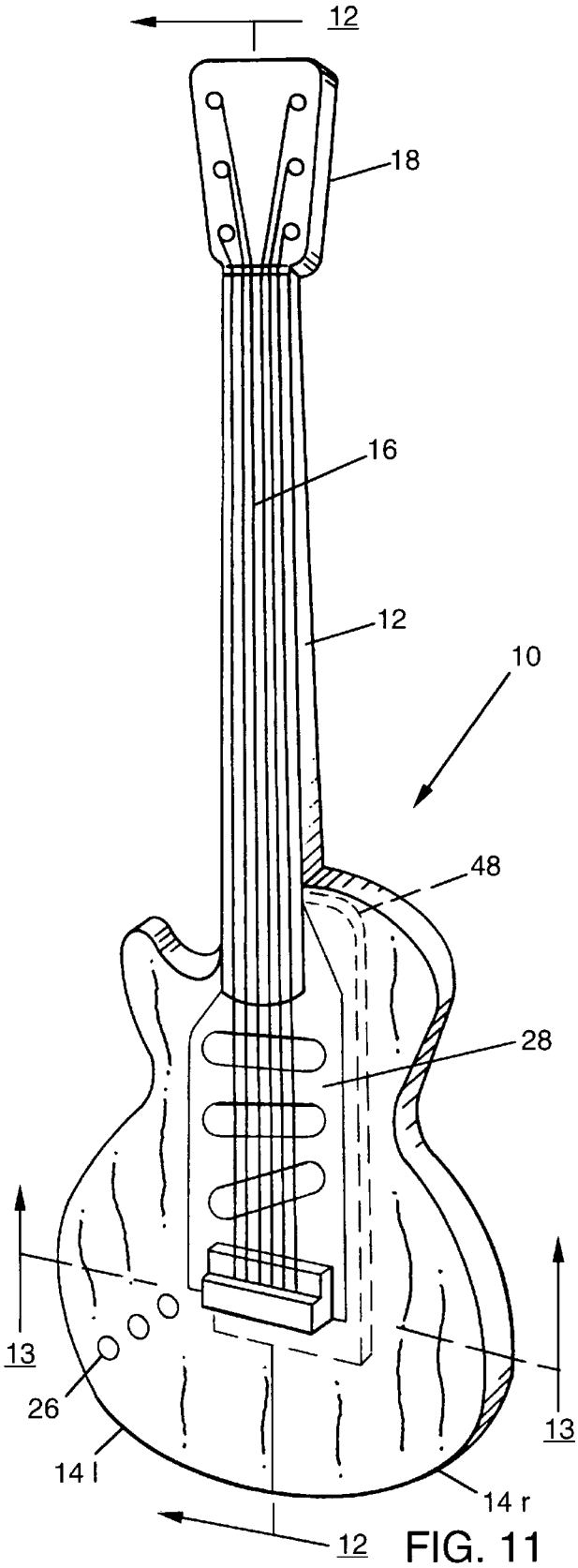
FIG. 11 is a perspective view of an alternative embodiment of a solid body guitar having a neck base formed into a large flat spline that communicates with the guitar body.
Figure 12:
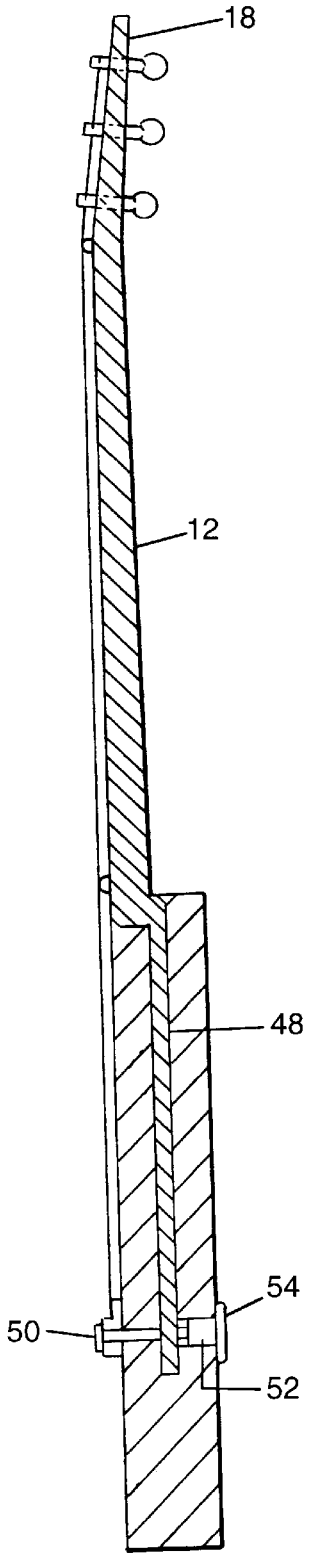
FIG. 12 is a sectional view of the alternative embodiment of FIG. 11 as taken through section 12—12 of FIG. 1.

FIG. 11 and 12 illustrate a further alternative embodiment of guitar 10 according to which the base of neck 12 is formed into a large flat spline 48. Flat spline 48 serves to join neck 12 to body 14 and sections 14*l* and 14*r* of solid body 14 to one another. Deep grooves along the inside edges of sections 14*l* and 14*r* receive spline 48. Once joined, flat spline 48 is sandwiched between layers of solid body 14. A plurality of bolts 50 (only one of which is shown in FIG. 12) bolt bridge stop 20 to body 14 and spline 48 through a plurality of bolt hole 52 drilled through body 14. A cover plate 54, affixed to the bottom of body 14, covers bolt holes 52.

Figure 13:
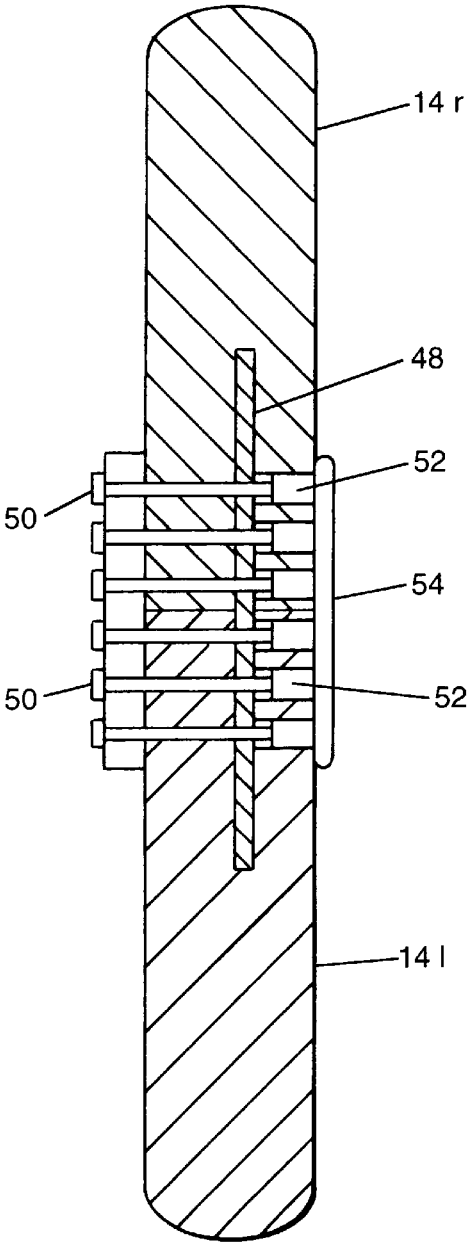
FIG. 13 is a sectional view showing the bridge bolted through the guitar body and neck spline as taken through section 13—13 of FIG. 11.

FIG. 13 is a sectional view taken along line 13 of FIG. 11 showing bridge stop 20 bolted through body 14 and spline 48, and cover plate 54 covering bolt holes 52.

The bolt through construction depicted in FIG. 13 serves to augment the transmission of vibrations from strings 16 through bridge stop 20 to body 14 and spline 48. The continuous nature of neck 12 and spline 48, and the large flat shape of spline 48 sandwiched between sections of body 14, serve to transmit vibrations from neck 12 throughout body 14. Vibrations are maximized in a coordinated manner, giving rise to an instrument with improved resonating characteristics and sound quality.

FIG. 14 illustrates a further alternative embodiment of solid body guitar 10 wherein the base of neck 12 forms the middle section 14*m* of a three-piece body 14. In this embodiment, neck 12 and section 14*m* are fabricated from a single piece of hardwood, while side body sections 14*r* and 14*l* are constructed of lighter albizzia wood. The neck through body construction provides a strong, though slightly heavier, instrument with good resonating features. The composite wood solid body results in tonal characteristics which vary depending upon the wood selected for neck 14 middle section 14*m*.

Whereas solid body guitars 10 depicted in FIGS. 1 through 14 exhibit left-handed configurations, it will be readily appreciated that the same preferred embodiments in right-handed configurations will be mirror images of those depicted and will achieve identical advantages.

Preparation of albizzia for use in solid body stringed instruments begins with harvesting the albizzia wood from trees selected for their form and dimensions. Trees having trunks of at least 24 inches in diameters, 25 or more feet high, and exhibiting a good system of horizontal growth (not crowded) are preferred because they exhibit wood quality and grain characteristics most suitable for instrument construction.

Once harvested, the wood is milled into planks having dimensions conforming to the dimensions of the solid body instrument the wood will be used to construct, and then cured or seasoned prior to use. Wood displaying properly oriented grain when quarter sawn is generally most stable.

Figure 15:
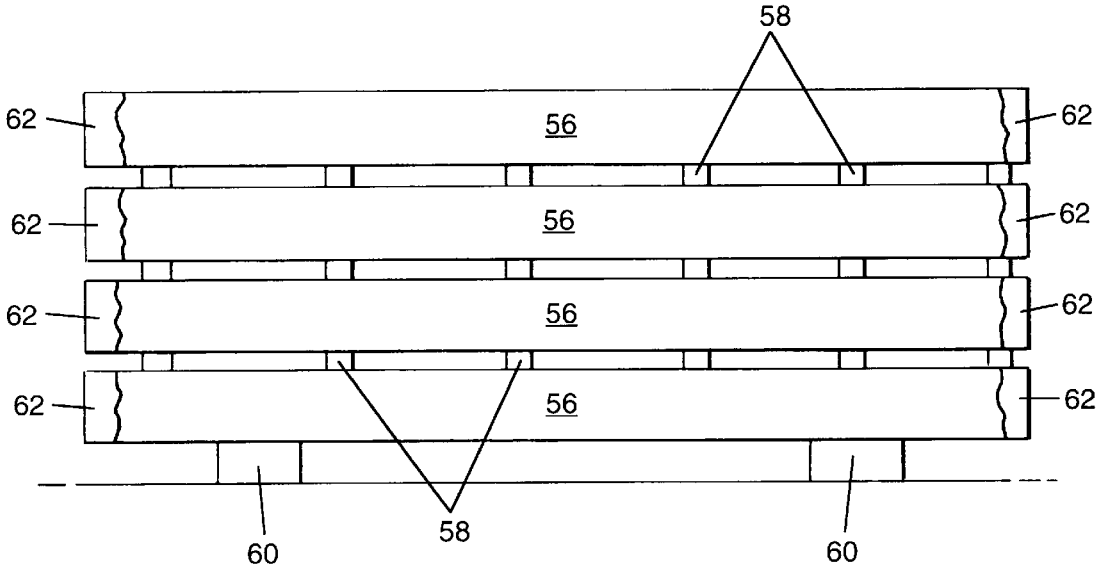
FIG. 15 is a side elevation view showing planks of albizzia wood staked for drying.

The curing process is implemented immediately upon milling the lumber and preferably takes place on site, or in the vicinity of the mill, prior to shipment. FIG. 15 is a side elevation view showing a plurality of unfinished planks 56 of albizzia wood stacked for curing according to a natural air drying process. Each layer of planks 46 is separated by a plurality of spacers 58 and the entire stack sits upon a number of base blocks 60. As depicted, planks 56 intended to comprise the body of an electric guitar are cut approximately 2 inches deep and 12 inches wide with the grain running lengthwise. A sealing means 62 is applied to the ends of planks 56 to lock in moisture during the drying process. Sealing means 62 may be paraffin oil followed, later, with oil based primers.

The curing process depicted in FIG. 15 is carefully regulated. Planks 56 are maintained in an environment of relatively constant temperature, generally above 70 degrees fahrenheit, and a relatively constant humidity, preferably below 20%, with constant air circulation. This natural process, which serves to stabilize the wood with minimal shrinkage, can take anywhere from several months to one or more years. The process is completed when the moisture content of albizzia planks 56 is reduced to between 5 to 13 percent. At the conclusion of the curing process, the wood is cut to shape and utilized.

The natural air drying process described and depicted in FIG. 15 can be augmented with kiln drying for increased efficiency. While the described natural process produces a highly stable cured wood product capable of producing high tonal qualities when employed in the solid body of a stringed instrument, alternative curing processes may be employed to season the green albizzia without departing from the spirit or scope of the claimed invention.

SUMMARY AND SCOPE

Accordingly, it will be readily appreciated that solid body stringed instruments constructed of albizzia wood provide strong, lightweight alternatives to currently available solid body instruments without sacrificing tonal quality or aesthetic appearance. Such solid body instruments, which are substantially lighter than their hardwood body counterparts, can be formed from a single piece of albizzia or from a plurality of pieces, arranged longitudinally, and joined using splines or other known methods.

Use of albizzia wood in solid body instrument construction avoids the complexity or cost involved in composite body construction while providing a similarly lightweight, durable and dependable, instrument. Because neck 12 and bridge stop 20 are anchored directly to the albizzia core of body 14, and not through intermediate structures as in composite construction, coordinated resonance among vibrating elements is maintained and sound degradation is minimized.

Alternative constructions in which neck 12 attaches at the top of the solid body 14 or traverses some or the entire of body 14 can be employed. A thin veneer skin can be added to cover the solid albizzia body for added strength and aesthetic effect. The described natural drying process gives rise to a stable wood that resists shrinkage and maximizes tonal qualities when employed in solid body stringed instrument.

Although the description above contains many specifications, these should not be construed as limiting the scope of the invention but merely providing illustrations of some of the presently preferred embodiments. For example, albizzia harvested from trees having a form and dimensions different from those described above, as well as albizzia wood cured through alternative processes including kiln drying, can be utilized in making solid body stringed instruments without departing from the spirit or scope of the present invention. Similarly, those skilled in the art will appreciate that the shape and configuration of solid body 14, style of neck 12 and number of strings and type of stringed instrument can be varied while maintaining the novel advantages described herein. Such modifications and variations are considered to be within the purview and scope of the present invention as defined in the appended claims and their legal equivalents.

The embodiments of the invention in which an exclusive property or privilege is claimed as defined as follows:

1. A musical instrument comprising a neck, a solid body fabricated from light weight albizzia wood, and a plurality of strings, wherein said solid body is attached to said neck and said strings are stretched from a point along said neck to a point on said solid body, and wherein said albizzia has been cured to provide a stable material capable of withstanding the forces of heavily tensioned strings without structural compromise while producing sounds of high tonal qualities.

2. The instrument of claim 1 wherein the grain of the albizzia wood comprising said solid body runs longitudinally from the end of said body where said body attaches said neck to the opposite end of said body.

3. The instrument of claim 1 wherein the instrument is a guitar.

4. The instrument of claim 1 wherein said body further comprises an electronic pickup mounted in the vicinity of said strings and used to amplify vibrations produced by said strings.

5. The instrument of claim 1 wherein said solid body is further comprised of a plurality of sections arranged longitudinally and joined to one another by an attaching means.

6. The instrument of claim 5 wherein the attaching means is splines running a portion of the length of the seams between said body sections and adhesive mating the said sections to one another and to said splines.

7. The instrument of claim 6 wherein said splines are rectangular in cross-section and rectangular grooves corresponding to said splines are cut in the sides of said sections to accommodate said splines.

8. The instrument of claim 7 wherein said splines are X-shaped in cross-section and X-shaped grooves corresponding to said splines are cut in the sides of said sections to accommodate said splines.

9. The instrument of claim 1 further comprising a thin veneer adhered to the outside surface of said albizzia body.

10. The instrument of claim 9 wherein said veneer is a wood laminate.

11. The instrument of claim 9 wherein said veneer is comprised of a synthetic resin.

12. The instrument of claim 11 further comprising artistic renderings embedded within said resin veneer.

13. The instrument of claim 1 wherein said neck traverses a substantial portion of the length of said solid body.

14. The instrument of claim 13 wherein the base of said neck is formed into a spline, said solid body is comprised of a plurality of longitudinally arranged sections, and said spline is used to join said neck to said body sections.

15. The instrument of claim 1 wherein said neck extends through the entire length of said body.

16. The instrument of claim 15 wherein said solid body is comprised of a middle section formed by the lower portion of said neck and two lateral body sections, one on each side of said neck, arranged longitudinally and made from albizzia wood.

17. The instrument of claim 16 wherein the portion of said neck which attaches to said lateral body sections is formed with splines that extend outward and wherein the sides of said lateral body sections which face inward are formed with grooves to receive said neck splines for bonding said lateral body sections to said neck.

18. A method for preparing albizzia wood for use in the construction of solid body stringed instruments comprising the steps of:

(a) selecting and harvesting wood from albizzia trees that demonstrate a good system of horizontal growth, are at least 24 inches in diameter and 20 to 30 feet in height;

(b) cutting said wood in planks having a depth and width which is slightly larger than the depth and width of the body of the instrument to be constructed from said wood, with the wood grain running lengthwise;

(c) immediately curing said planks using a means which dries said wood while maintaining its size and shape; and (d) utilizing said cured planks in the construction of solid body stringed instruments.

19. The method of claim 18 wherein said curing means is a natural air drying process comprising stacking said planks with space maintained between each said plank, coating the ends of said planks with a sealing means, causing the air around and between said planks to continually circulate, and regulating the environment of said planks at a relatively constant temperature and humidity, until a suitable wood moisture content is reached.

* * * * *